US007057517B1

(12) United States Patent
Convery

(10) Patent No.: US 7,057,517 B1
(45) Date of Patent: Jun. 6, 2006

(54) ALARM NETWORK

(76) Inventor: Joseph Convery, 621 Colford Ave., Collingswood, NJ (US) 08108

( * ) Notice: Subject to any disclaimer, the term of this patent is extended or adjusted under 35 U.S.C. 154(b) by 7 days.

(21) Appl. No.: 10/053,849

(22) Filed: Jan. 22, 2002

(51) Int. Cl.
*G08B 17/00* (2006.01)

(52) U.S. Cl. ..... 340/628; 340/286.02; 340/286.05; 340/286.11; 340/629; 340/539.1; 340/539.14

(58) Field of Classification Search ..... 340/628, 340/629, 630, 632, 539.1, 309.16, 539.14, 340/521, 286.02, 286.05, 286.11
See application file for complete search history.

(56) References Cited

U.S. PATENT DOCUMENTS 4,417,235 A 11/1983 Del Grande
4,904,988 A * 2/1990 Nesbit et al. ..... 340/628
5,587,705 A 12/1996 Morris
6,078,269 A 6/2000 Markwell et al.
6,130,412 A 10/2000 Sizemore
6,420,973 B1 * 7/2002 Acevedo ..... 340/628
6,437,698 B1 * 8/2002 Byrne et al. ..... 340/630
6,708,269 B1 * 3/2004 Markwell et al. ..... 340/825.5
2002/0126016 A1 * 9/2002 Sipp ..... 340/628

* cited by examiner

*Primary Examiner*—Julie Bichngoc Lieu

(57) ABSTRACT

A wireless alarm network which detects smoke or toxic gas or fire or other abnormal environmental conditions within and in the vicinity of a structure wherein the detector at the source of the abnormal environmental condition emits an audible alarm and communicate the abnormal condition to the other members of the alarm network remote from the location of the abnormal condition by coded radio frequency signals. All alarm devices within the network comprise of radio frequency receivers and upon receiving a trouble message they issue their own audible alarm to alert people in remote areas from the trouble who otherwise would not hear the alarm sounded at the site of the trouble. Once people are notified of the trouble in all areas of the structure they have an option of using a handheld radio transmitter provided to disable alarms from locations remote from the location of the actual trouble to aid in the localization of the actual trouble spot.

2 Claims, 2 Drawing Sheets

ALARM NETWORK

FIELD OF INVENTION

This invention relates to smoke, toxic gas, and fire alarms and more particularly to alarm networks containing numerous units within a building. The alarm units within the network are monitoring each other, and upon detection of an alarm issued by any of the units all other alarm units in the system issue their own alarm to alert occupants within the building who would not otherwise hear the alarm from the location of the original source of the problem.

DESCRIPTION OF PRIOR ART

Various alarm networks has been proposed and built in the past to alert people to danger in locations within a building remote from the source of the problem. The most widely used system utilize multiple detectors located throughout the structure which are wired together into a network, whereupon all of them sound the alarm when any of one the detectors detecting a problem condition. The advantage of this system is that the alarm is sounded in numerous parts of the structure simultaneously with the detection of a problem in a single and perhaps remote location from the occupant of the building. The system can be installed relatively easily during new constructions, but the cost of installation in an existing or old structure is excessive, and often prohibitive.

To overcome the excessive installation cost of the wired systems, numerous individual battery-operated detectors are being installed in homes and offices. While this system has a low installation cost it also has a serious disadvantage. When fire or smoke is detected in a location remote from the occupant of the structure, let's say in the basement while the occupant is sleeping in a second floor bedroom, the occupant will not hear the early warning alarm from the basement, and will not wake up until the smoke penetrates throughout the building and the alarm on the second floor is sounded. Valuable time to respond to the fire is lost, and the occupant has to step out from the clear bedroom into a house already filled up with smoke.

To improve on the alarm systems containing independent units, various wireless interactive networks have been proposed in the past. These networks are designed to repeat the alarms at locations remote from the source of the fire, smoke, toxic gas or other troubles the system is designed to protect against. An Audible Alarm Network has been proposed by Del Grande (U.S. Pat. No. 4,417,235) wherein the individual smoke detectors also contain a sound detector, which monitor the alarms issued by other units within the system, enabling the unit to respond to the detection of either an abnormal condition or the audible alarm signal of any other alarm units in the system. Detection of the abnormal condition at any location in the building will result in the activation of all of the other alarms in the network. Morris (U.S. Pat. No. 5,587,705) and Markwell et. al. (U.S. Pat. No. 6,078,269) proposed RF linked networks, wherein in addition to the smoke sensing components each unit also contains RF signal emitting and sensing circuitry. When a detector senses smoke, it emits an audible alarm of continuous tone, and it also emits an RF signal directly to other like smoke detectors to activate their alarms.

The disadvantage of the wireless networks are the false alarms created by other RF devices within and in the vicinity of the buildings, such as the garage door openers, lighting controls, wireless telephones and similar devices. To overcome these false alarms, expensive signal conditioning and discriminating circuitry is often used, which significantly increases the cost of these devices. Confusion is created throughout the building when the alarms of the various units in the networks are activated simultaneously, which makes difficult to quickly locate and eliminate the source of the problem. Most detectors are ceiling mounted and require significant effort of climbing up and turning off each individual alarm repeating units which are not in the location of the actual problem, delaying actions to fight the fire or other problems being detected. What has occurred to date is that not withstanding the teachings of the prior art, the ability to provide an inexpensive and reliable smoke detection network system has remained unresolved.

OBJECTS AND ADVANTAGES OF THE INVENTION

Responding to the above described unresolved need; this invention provides an inexpensive method to eliminate false alarms caused by auxiliary sound or RF devices. The invention attains this goal by providing a time delay in the sound or RF signal detection circuit before an alarm is sounded which is not in direct response to smoke or other problem being detected by the network.

It is another object of the present invention to further enhance the improved alarm network by incorporating a handheld remote device within the network, which can turn off the repeat alarms issued by those devices in the network which do not experience smoke or other troubles at their own location. Turning off the repeater alarms aids in the quick location of the problem by directing the persons to the alarm at the location of the fire or other trouble being sensed by the system.

Other objects and advantages will also be apparent from the examination of the drawings and the claims.

DESCRIPTION OF THE PREFERRED EMBODIMENTS

Figure 1:
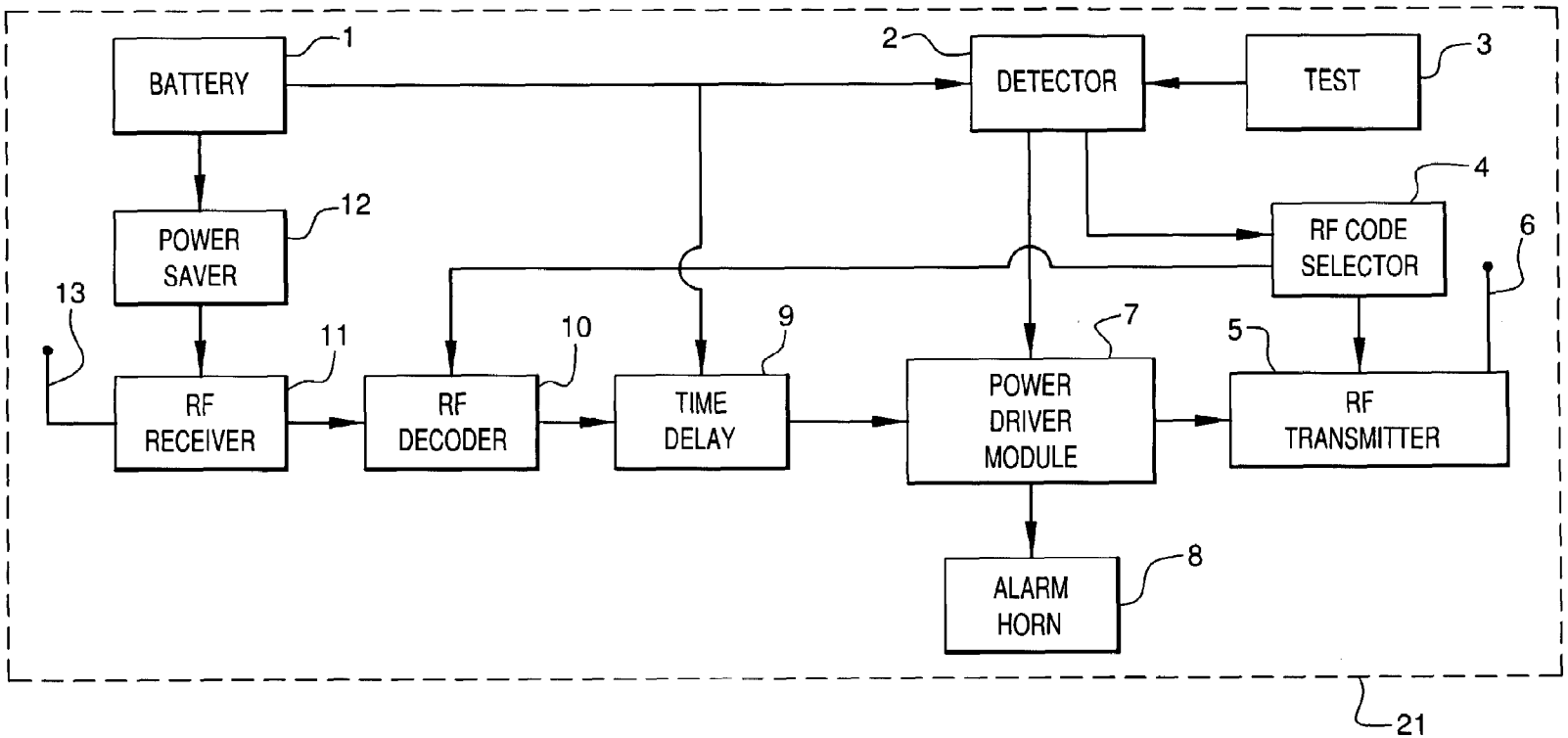
FIG. 1 shows a block diagram of a single device of the improved alarm network in its simplest configuration.

Referring in detail to the drawings, the reference numerals herein refer to the like numbered parts in the drawings.

The alarm network consist of two or more independent alarm devices, each having the capability to detect one or more problems, such as smoke, toxic gas, fire, high or low temperatures, water or other abnormal environmental conditions. FIG. 1 shows a block diagram of a single alarm device 21 of the alarm network in its simplest configuration. A 9 VDC alkaline battery 1 powers the device. The detector 2 is a commercially available smoke, gas, temperature, or water sensor designed to differentiate between normal and abnormal conditions. Upon detecting an abnormal condition, the detector 2 sends a signal to the power driver module 7 to energize the alarm horn 8 to issue a constant blaring audible alarm, and to maintain it as long as detector 2 is detecting the abnormal condition. Concurrently with issuing the audible alarm, detector 2 also sends a signal through the RF code selector 4 to the RF transmitter 5 to radiate a coded RF signal toward the other members of the alarm network via antenna 6 and to maintain radiating the signal as long as detector 2 is detecting the abnormal condition. The RF code selector 4 module contains a bank of switches for the user to select a modulated RF signal, which does not interfere with the known garage door openers, light switches, and other various other RF devices within the range of the RF transmitter 5 and within the control of the user. The RF decoder 10 also contains a bank of switches for the user to select the same modulated RF signal as selected for RF code selector 4. User shall select the same RF code in all RF code selectors 4 and RF decoders 10 within the alarm network. The alarm device 21 contains RF receiver 11, which monitors the airwaves for RF signals from the other alarm devices 21 within the alarm network via RF receiver antenna 13. Continuous monitoring of the airwaves would deplete battery 1 within a few days. To conserve battery power, a power saver module 12 is employed. It is typically a microprocessor device having extremely low leakage current in the standby mode. The power saver module 12 provides power to the RF receiver 11 in a low duty cycle mode, for approximately 50 milliseconds in every 3 seconds. When a coded RF signal is received by RF receiver 11 it is transmitted to the RF decoder 10 for verification that the coded RF signal is matching the one set by the user. However, even when a match is confirmed, there is no assurance that the coded RF signal matching the code set in the RF decoder 10 actually came from the alarm network. The signal could have come from a passing automobile, from a neighboring garage door opener or light switch outside of the alarm network. If the signal from the RF decoder 10 would be passed to the power driver module 7 without further scrutiny, it would result in a false alarm. The operating duration of coded RF devices such as garage door openers or the passing of automobiles is typically a few seconds. Therefore, the coded RF signal is passed from the RF decoder 10 to a time delay 9 before it is transmitted to the power driver module 7. Time delay 9 should be set for approximately 10 seconds to allow the violation by an outside RF device to cease, a car to pass, or a garage door opened, before the coded RF signal is transferred to the power driver module 7. During the 10 seconds time delay the RF receiver is turned on 3 times for 50 milliseconds each time. Upon receipt of three consecutive qualified coded RF signals 3 seconds apart within the 10 seconds delay period from the RF decoder 10 the time delay 9 will release a signal to power driver module 7 to energize the alarm horn 8 to issue a constant blaring audible alarm, and to maintain it for thirty seconds. Concurrently with issuing the audible alarm via alarm horn 8, power driver module 7 also sends a signal to the RF transmitter 5 to radiate a coded RF signal toward the other members of the alarm network via antenna 6 for a period of 30 seconds. A test switch 3 is provided for the user to periodically simulate an abnormal condition of detector 2 for testing the alarm network.

Figure 2:
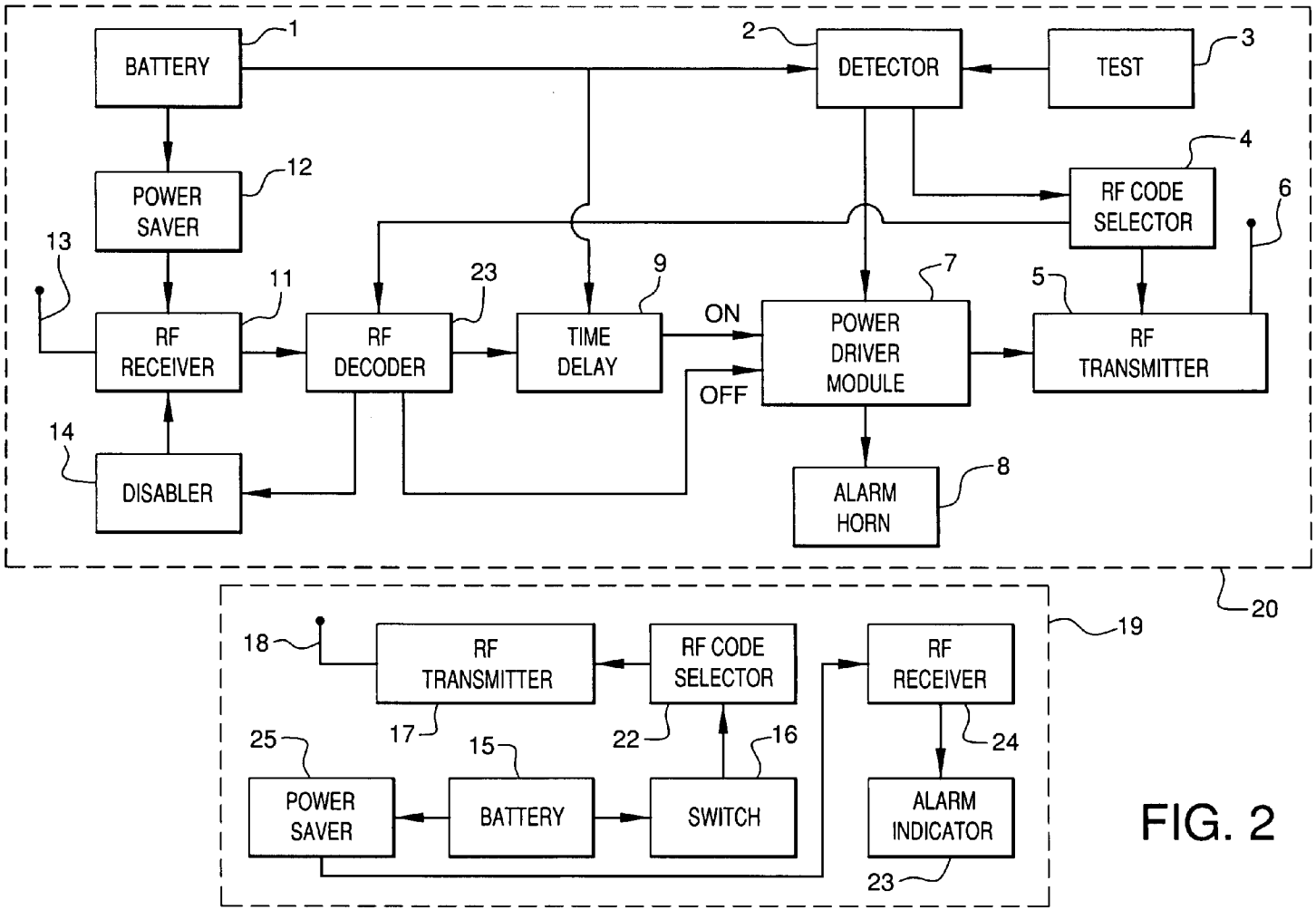
FIG. 2 shows block diagrams of an advanced version of a single device and a handheld remote controller of the improved alarm network.

An advanced configuration of the preferred embodiment is shown in FIG. 2.

The advanced configuration alarm network consist of two or more independent alarm devices 20, each having the capability to detect one or more problems, such as smoke, toxic gas, fire, high or low temperatures, water or other abnormal environmental conditions and a handheld remote controller 19. A 9 VDC alkaline battery 1 powers the alarm device 20. The detector 2 is a commercially available smoke, gas, temperature, or water sensor designed to differentiate between normal and abnormal conditions. Upon detecting an abnormal condition, the detector 2 sends a signal to the power driver module 7 to energize the alarm horn 8 to issue a constant blaring audible alarm, and to maintain it as long as detector 2 is detecting the abnormal condition. Concurrently with issuing the audible alarm, detector 2 also sends a signal through the RF code selector 4 to the RF transmitter 5 to radiate a coded RF signal toward the other members of the alarm network via antenna 6 and to maintain radiating the signal as long as detector 2 is detecting the abnormal condition. The RF code selector 4 module contains a bank of switches for the user to select a modulated RF signal, which does not interfere with the known garage door openers, light switches, and other various other RF devices within the range of the RF transmitter 5 and within the control of the user. Alarm device 20 includes a two-channel RF decoder 23. The two channel RF decoder 23 contains switches for the user to select the same modulated RF signal for the first channel of RF decoder 23 as selected for RF code selector 4. User shall select the same RF code in all RF code selectors 4 and RF decoders 23 within the alarm network. The alarm device 20 contains RF receiver 11, which monitors the airwaves for RF signals from the other alarm devices 20 within the alarm network via RF receiver antenna 13. Continuous monitoring of the airwaves would deplete battery 1 within a few days. To conserve battery power, a power saver module 12 is employed. It is typically a CMOS device having extremely low leakage current in the standby mode. The power saver module 12 provides power to the RF receiver 11 in a low duty cycle mode, for approximately 50 milliseconds in 3 seconds. When a coded RF signal is received by RF receiver 11 it is transmitted to the first channel of the RF decoder 23 for verification that the coded RF signal is matching the one set by the user in the first channel of the RF decoder 23. However, even if a match is confirmed, there is no assurance that the coded RF signal matching the code set by the user actually came from the alarm network. The signal could have come from a passing automobile, from a neighboring garage door opener or light switch outside of the alarm network. If the signal from the RF decoder 23 would be passed to the power driver module 7 without further scrutiny, it would result in a false alarm. The operating duration of coded RF devices such as garage door openers or the passing of automobiles is typically a few seconds. Therefore, the coded RF signal is passed from the RF decoder 23 to time delay 9 before it is transmitted to the power driver module 7. Time delay 9 should be set for approximately 10 seconds to allow the violation by an outside RF device to cease, a car to pass, or a garage door opened, before the coded RF signal is transferred to the power driver module 7. During the 10 seconds time delay the RF receiver is turned on 3 times for 50 milliseconds each time. Upon receipt of three consecutive qualified coded RF signals 3 seconds apart within the 10 seconds delay period from the RF decoder 23 the time delay 9 will release a signal to power driver module 7 to energize the alarm horn 8 to issue a constant blaring audible alarm. Concurrently with issuing the audible alarm via alarm horn 8, power driver module 7 also sends a signal to the RF transmitter 5 to radiate a coded RF signal toward the other members of the alarm network via antenna 6. When numerous independent alarm devices 20 of the alarm network are activated simultaneously within the building, it becomes difficult to quickly locate and eliminate the source of the problem. The handheld remote controller 19 is used to deactivate the alarm devices 20 which are only repeating an alarm but do not sense an abnormal environmental condition at their location, and leave active only the alarm device 20 at the origin of the fire or other abnormal condition.

FIG. 2 also shows the block diagram of the handheld remote controller 19. A 9 VDC alkaline battery 15 powers the handheld remote controller 19. The user sets both the RF code selector 22 and the second channel of RF decoder 23 for a modulated RF signal different from the modulated signal set in RF code selector 4. To deactivate the alarm devices 20 which are repeating the alarm and leave active the alarm device 20 at the origin of the fire or other abnormal condition the user closes switch 16 for at least 3 seconds to energize RF transmitter 17 which in turn sends the modulated RF signal set in RF code selector 22 toward all alarm devices 20 via RF antenna 18. Signal from RF transmitter 17 is received by RF receiver 11, which transmits the coded signal to RF decoder 23. If the coded signal matches the code set by the user in the second channel of RF decoder 23, then RF decoder 23 sends a signal to disabler 14 to deactivate RF receiver 11 for a period of approximately 3 minutes. Simultaneously RF decoder 23 sends a signal to power driver module 7 to momentarily deactivate alarm horn 8 and RF transmitter 5. All devices 20 of the alarm network will cease emitting the audible alarms and RF signals. Detector 2 in the device 20 at the source of the fire or other abnormal condition will immediately reactivate RF transmitter 5 and alarm horn 8 via power module 7 to indicate the location of the fire or other abnormal condition. Disabler 14 will release the deactivating hold on RF receiver 11 after 3 minutes of hold. If the user did not remedy the abnormal condition within the 3 minutes hold period, then all repeating alarm devices 20 will be reactivated automatically.

The possibility exists that due to a false alarm or temporary smoke condition batteries 1 of alarm devices 20 are completely depleted while the users are not on the premises. If this condition remains undetected then the alarm network is compromised. To eliminate this possibility, the handheld device 19 also contains an RF receiver 24 to receive alarm messages from RF transmitter 5. Upon receiving an alarm message, RF receiver 24 sends a signal to alarm indicator 23 to issue a 1 second duration beep once every minute, to indicate to the user upon their return that an alarm condition existed in their absence, and the batteries 1 in the alarm network should be checked and perhaps replaced. Alternatively the alarm indicator 23 may use a flashing LED in addition to or instead of the 1-second beeps to indicate that an alarm condition existed.

While the preceding description contain many specificities, these should not be construed as limitations on the scope of the invention, but rather as an exemplification of a preferred embodiments thereof. Many other variations are possible. Skilled artisans will readily be able to change timings and sequence of operations of the various components described in the embodiments and adopt the invention to numerous other applications. Accordingly, the scope of the invention should be determined not by the embodiments illustrated, but by the appended claims and their legal equivalents.

I claim:

1. An alarm network for the detection of smoke or toxic gas or fire or other abnormal environmental conditions, comprising:

A. two or more alarm devices, each device comprising sensor means for sensing the presence of one or more said abnormal environmental conditions, each said alarm device comprising an audible alarm, each said alarm device comprising a user selectable coded radio frequency transmitter for wireless communication of alarm messages of said abnormal environmental condition to the other said alarm devices in said alarm network, each said alarm device comprising a user selectable coded radio frequency receiver to receive said coded radio frequency alarm messages of said abnormal environmental condition from other said alarm devices in said alarm network;

B. each alarm device comprising means to activate said audible alarm when said abnormal environmental conditions sensed by said sensor means, each alarm device comprising means to activate said radio frequency transmitter when said abnormal environmental conditions sensed by said sensor means, each alarm device comprising means to activate said audible alarm when said coded radio frequency alarm message of said abnormal environmental condition is received by said radio frequency receiver from other said alarm device in said alarm network;

C. wireless means for indicating that said audible alarm has been activated after the termination of said audible alarm;

D. wireless means to disable emission of said audible alarm from said alarm devices of said alarm network not at the location of said abnormal environmental condition;

E. wireless means to disable transmission of said radio frequency alarm message from said alarm devices of said alarm network not at the location of said abnormal environmental condition; and F. wireless means to disable reception of said radio frequency alarm message from said alarm devices of said alarm network.

2. An alarm network for the detection of smoke or toxic gas or fire or other abnormal environmental conditions as defined in claim 1, further comprising:

time delay means to eliminate false alarm messages from radio frequency devices outside of said alarm network.

* * * * *